US008813807B1

(12) United States Patent
LeBlanc

(10) Patent No.: US 8,813,807 B1
(45) Date of Patent: Aug. 26, 2014

(54) WINDOW SHADE LIFTING APPARATUS

(71) Applicant: Lewis Hyman, Inc., Carson, CA (US)

(72) Inventor: Robert LeBlanc, Kennesaw, GA (US)

(73) Assignee: Lewis Hyman, Inc., Carson, CA (US)

( * ) Notice: Subject to any disclaimer, the term of this patent is extended or adjusted under 35 U.S.C. 154(b) by 0 days.

(21) Appl. No.: 14/224,805

(22) Filed: Mar. 25, 2014

(51) Int. Cl.
*E06B 9/262* (2006.01)
*E06B 9/264* (2006.01)

(52) U.S. Cl.
CPC ..... *E06B 9/264* (2013.01); *E06B 9/262* (2013.01)
USPC ..... 160/84.01

(58) Field of Classification Search
CPC ..... E06B 9/262; E06B 2009/2622; E06B 2009/2625
USPC ..... 160/84.01
See application file for complete search history.

(56) References Cited

U.S. PATENT DOCUMENTS

| | | | | |
|---|---|---|---|---|
| 5,743,319 | A * | 4/1998 | Christopherson | 160/173 R |
| 5,918,657 | A * | 7/1999 | Tuzmen | 160/168.1 R |
| 8,316,911 | B2 * | 11/2012 | Cleaver | 160/84.01 |
| 8,365,795 | B2 | 2/2013 | Perkowitz | |
| 8,381,792 | B2 | 2/2013 | Perkowitz | |
| 8,474,507 | B2 * | 7/2013 | Anthony et al. | 160/84.01 |
| 8,505,607 | B2 | 8/2013 | Perkowitz | |
| 8,544,522 | B2 * | 10/2013 | Lin | 160/84.01 |
| 2010/0212839 | A1 * | 8/2010 | Wang | 160/84.04 |
| 2011/0094685 | A1 * | 4/2011 | Morris et al. | 160/84.04 |
| 2011/0132555 | A1 | 6/2011 | Rowley et al. | |
| 2011/0180222 | A1 * | 7/2011 | Huang | 160/368.1 |
| 2011/0186242 | A1 | 8/2011 | Foley et al. | |
| 2011/0209834 | A1 * | 9/2011 | Lowry et al. | 160/84.04 |
| 2011/0308742 | A1 * | 12/2011 | LeBlanc | 160/84.04 |
| 2011/0308746 | A1 | 12/2011 | LeBlanc | |
| 2012/0168094 | A1 * | 7/2012 | Lin | 160/84.04 |
| 2013/0020037 | A1 * | 1/2013 | Perkowitz | 160/241 |

* cited by examiner

*Primary Examiner* — Blair M Johnson
(74) *Attorney, Agent, or Firm* — Jones Day

(57) ABSTRACT

A window shade lifting apparatus that includes a tube disposed vertically on the window shade; a lifting cord disposed in the compression tube; a ladder structure including a vertical leg and a plurality of rungs, the ladder structure being connected to the tube; and connection rings, each connection ring connecting the ladder structure to the window shade.

20 Claims, 9 Drawing Sheets

WINDOW SHADE LIFTING APPARATUS

GOVERNMENT LICENSE RIGHTS

This invention was not made with government funding or support.

FIELD OF THE INVENTION

Embodiments of the present invention relate generally to window coverings. More particularly, the invention is directed to a window shade lifting mechanism for a shade, such as a roman shade.

BACKGROUND OF THE INVENTION

Window coverings, such as shades or blinds, typically have a horizontal or vertical covering to prevent sunlight from entering an area and to retain privacy. The covering, which is commonly in the form of slats or pleats, can hang vertically in the case of a vertical covering, or can extend horizontally from a headrail in the case of a horizontal covering. Many window coverings also include a bottom rail as well.

Typically in order to raise and lower the bottom rail relative to the floor, a looped cord extends from a point along the bottom rail through the slats and into the headrail. Two or more cords are often provided to raise or lower the window covering evenly. The window covering is raised or lowered by pulling or releasing the accessible portion of the cords. Inventions directed to minimizing or eliminating the possibility of entanglement in the cord by passing the cord through structures such as tapes or loops affixed to the shade are disclosed, for example, in U.S. Application Publications 2011/0132555 and 2011/0186242. However, such structures and their manner of attachment to the shade can impede normal movement of the lifting cord, thereby resulting in stiff operation. Also, such shades can be time-consuming and costly to manufacture. There is therefore still a need for improved shades that reduce the danger of cord entanglement.

SUMMARY OF THE INVENTION

An embodiment of the present invention includes a safety lifting apparatus for a window shade. A system for preventing unsafe extension of a lifting cord is provided that achieves free movement of the lifting cord in normal operation, as well as improved manufacturability. In a preferred embodiment, the improved safety lifting apparatus includes a compression tube, a ladder system affixed to the exterior of the compression tube, and connection rings for attaching the ladder system to a window shade at arbitrary points along the shade. Preferably, a friction cap is included at the bottom of the compression tube, to seal the tube. Optionally, the compression tube is manufactured with a guide cord included in the body of the tube. When producing the shade, the guide cord is used to thread the shade lifting cord through the compression tube. This saves significant labor cost in production and speeds up assembly.

In operation, the lifting cord moves freely through the compression tube unimpeded by the hardware connecting the tube to the shade, since the connection rings of the preferred embodiment are connected to the exterior of the tube via the ladder system, and do not impinge upon the interior of the tube or the lifting cord therein.

A friction cap is provided at the bottom of the compression tube, thereby sealing the tube so that the cord is not exposed.

The embodiments of the shade are designed to exceed safety standards, in particular the Hazardous Loop Test of ANSI Standard WCMA 100.1-2012. When force is exerted to pull the compression tube and corresponding ladder assembly, horizontal and vertical extension are limited to set distances based on ring placement on the shade. With appropriate ring placement, the maximum extension can be readily limited to that required by industry safety standards.

In one embodiment, a window shade lifting apparatus comprises at least one tube disposed substantially vertically on a window shade, a lifting cord disposed in the tube, and a ladder structure including a vertical leg and a plurality of rungs. In an embodiment, the plurality of rungs is connected to the exterior of the tube. In an embodiment, the shade lifting apparatus further comprises at least two connection rings, each connection ring connecting the ladder structure to the window shade.

In another embodiment, a window shade lifting apparatus comprises at least one compression tube formed of a woven material, a lifting cord in the compression tube, a ladder structure comprising a vertical leg and a plurality of rungs having a certain distance between each rung and connected at one end to the exterior of the compression tube, and a plurality of connection rings, each such connection ring passing through a space between adjacent rungs and attached to a window shade.

In another embodiment, a window shade lifting apparatus comprises at least two compression tubes formed of woven material, a lifting cord in the compression tube, a ladder structure comprising a vertical leg and plurality of rungs, a first end of each rung being connected to the exterior of one of the compression tubes, a second end of each rung being attached to the vertical leg. This embodiment includes a plurality of connection rings, with each ring being substantially circular, the rings connecting the ladder structure to the window shade by passing around the vertical leg, passing through a space between adjacent rungs, and passing around a thread woven between slats of the window shade.

DETAILED DESCRIPTION OF THE EMBODIMENTS OF THE INVENTION

Window coverings such as shades are typically raised or lowered by pulling or releasing a lifting cord that extends from the bottom rail of the shade to the head rail of the shade, passing through the slats or pleats arrayed between the bottom rail and head rail. Inventions directed to minimizing or eliminating the possibility of entanglement in the cord by passing the cord through structures such as tapes or loops affixed to the shade are known. However, such structures and their manner of attachment to the shade can impede normal movement of the lifting cord, thereby resulting in stiff operation. Such known structures can also be difficult to manufacture.

Embodiments of the present invention include a safety lifting apparatus for a window shade, wherein a system for preventing unsafe extension of a lifting cord is provided that achieves free movement of the lifting cord in normal operation, as well as improved manufacturability. In a preferred embodiment, the improved safety lifting apparatus includes a compression tube, a ladder system affixed to the exterior of the compression tube, and connection rings for attaching the ladder system to a window shade at arbitrary points along the shade.

Figure 1:
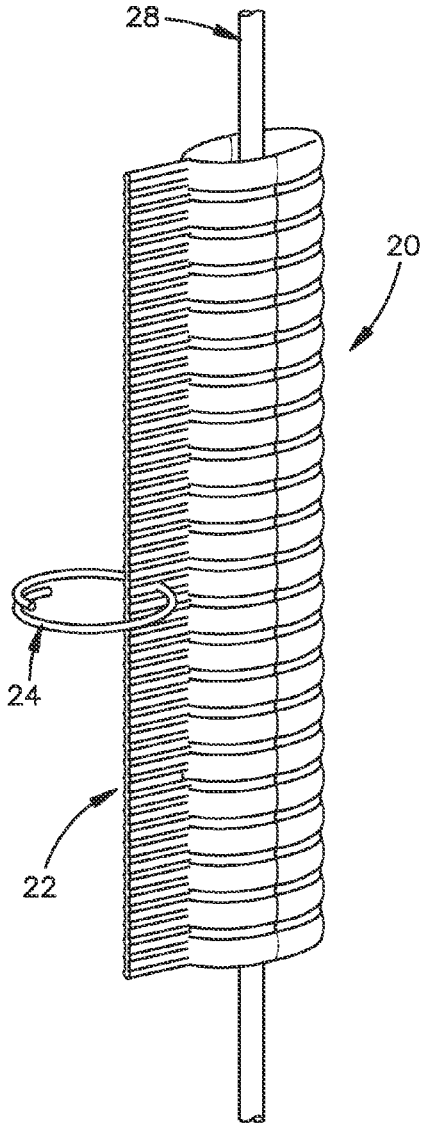
FIG. 1 shows a perspective view of a safety lifting apparatus according to an embodiment of the present invention, including a compression tube, guide cord, ladder material, and connection ring.

FIG. 1 depicts an embodiment of the safety lifting apparatus of the present invention. As shown in FIG. 1, ladder material 22 is attached to the exterior of compression tube 20. In a preferred embodiment, ladder 22 extends along substantially the entire length of compression tube 20. In a preferred embodiment, compression tube 20 is about 57.75 inches long on a 72-inch shade drop. In a preferred embodiment, compression tube 20 has a diameter of about 0.375 inches. A connection ring 24 is depicted as attached to the ladder 22 by being threaded through a space between adjacent rungs of ladder 22. While here a single connection ring is shown for clarity, it will be understood that, in general, an instance of the inventive safety lifting apparatus may employ a plurality of connection rings 24, arrayed along ladder 22. Also shown is a lifting cord 28.

Figures 11A, 11B, 11C:
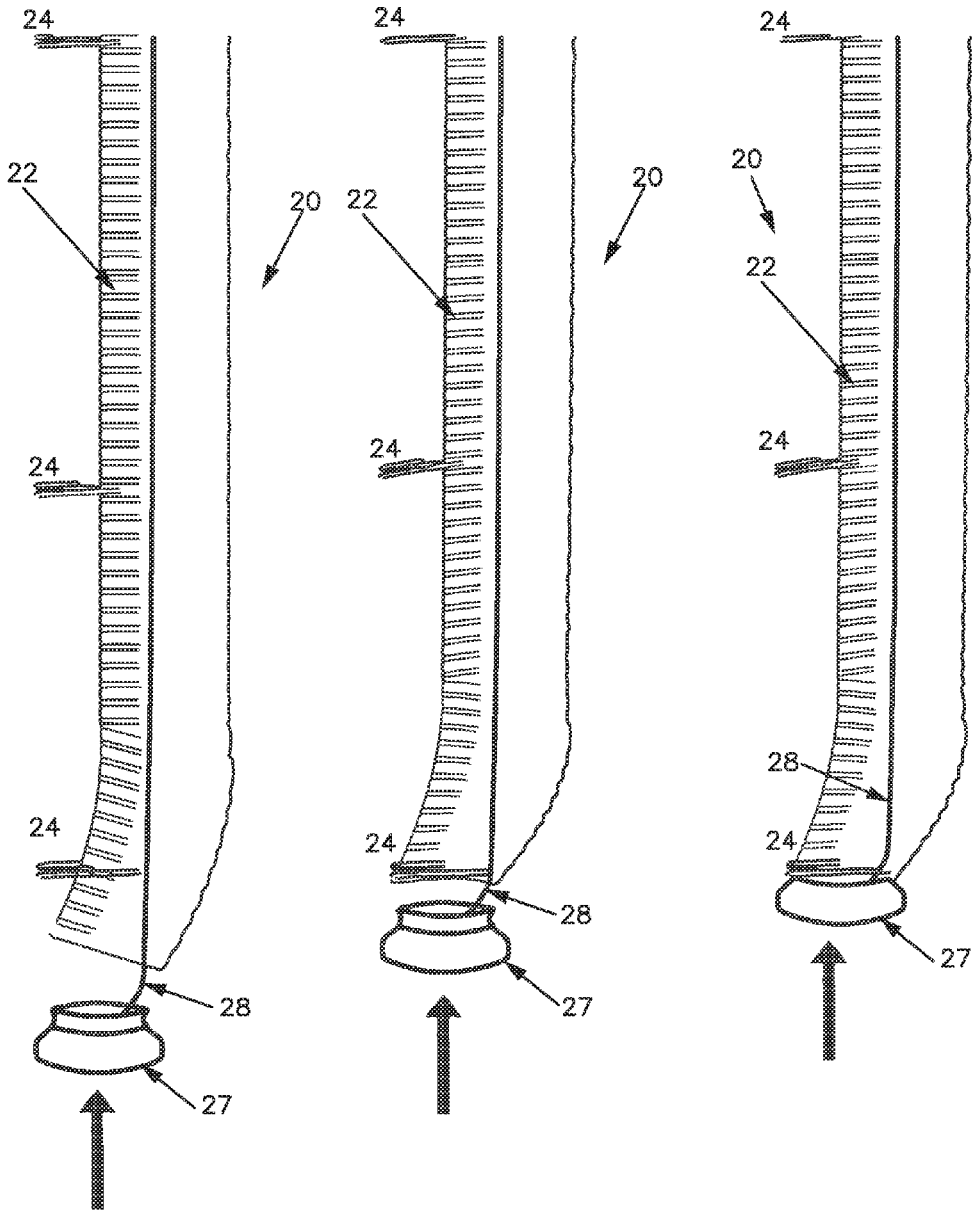
FIG. 11A shows a first step in an exemplary method of securing the bottom of a compression tube using a friction cap.
FIG. 11B shows another step in an exemplary method of securing the bottom of a compression tube using a friction cap.
FIG. 11C shows yet another step in an exemplary method of securing the bottom of a compression tube using a friction cap.
Figure 11E:
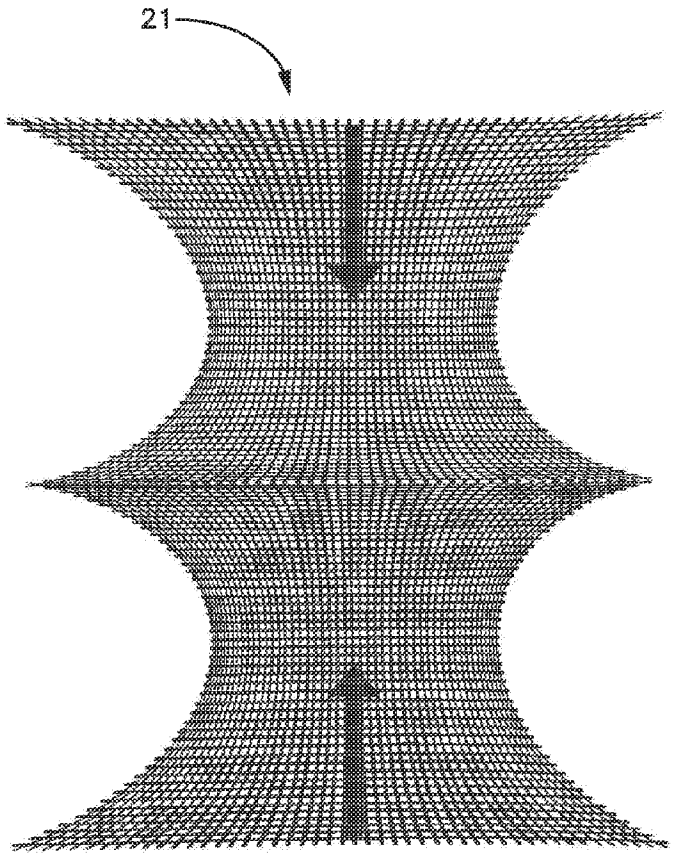
FIG. 11E shows woven material for making a compression tube in a compressed state.
Figure 11D:
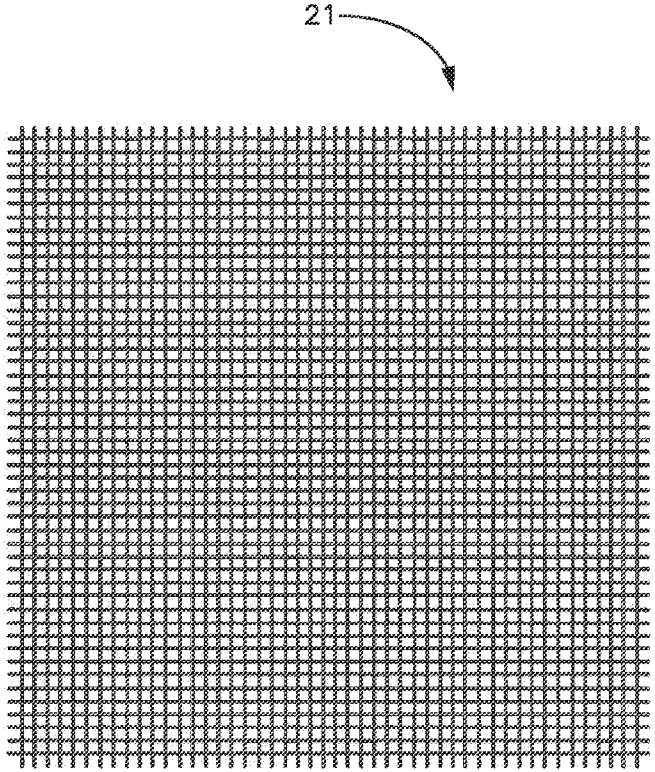
FIG. 11D shows woven material for making a compression tube.

Compression tube 20 is preferably made of a woven material. In one embodiment, compression tube 20 is made of polyester. In another embodiment, compression tube 20 is made of a polyester blend. In a preferred embodiment, compression tube 20 is made of a woven material characterized by a linear and vertical weave, yielding excellent flexibility. See FIG. 11D. As shown in FIG. 11E, when the compression tube material 21 is woven in this manner, it allows the compression tube 20 to collapse in a vertical dimension when the shade is pulled up (compression tube in compression), while still allowing room for the lifting cord to flow freely through the center of compression tube 20.

Preferably, ladder 22 is made of the same material as compression tube 20. In one embodiment, ladder 22 and compression tube 20 are made as a single, integral structure. In another embodiment ladder 22 and compression tube 20 are made separately and then joined.

In an embodiment, connection ring 24 is made of plastic. In another embodiment, connection ring 24 is made of metal. In a preferred embodiment, connection ring 24 is made of metal wire. In a preferred embodiment, connection ring 24 is in the form of a self-overlapping ring, resembling a common key ring, in order to facilitate passing the ring between rungs of ladder 22. In a preferred embodiment, the amount of overlap is preferably 25% of the ring, but may vary from 25% to about 75%. The preferred embodiment of the ring 24 includes the one ring having the overlap as shown but other embodiments within the scope of the present invention include one ring having several concentric circles overlapping each other and connected to the ladder 22.

Figure 2:
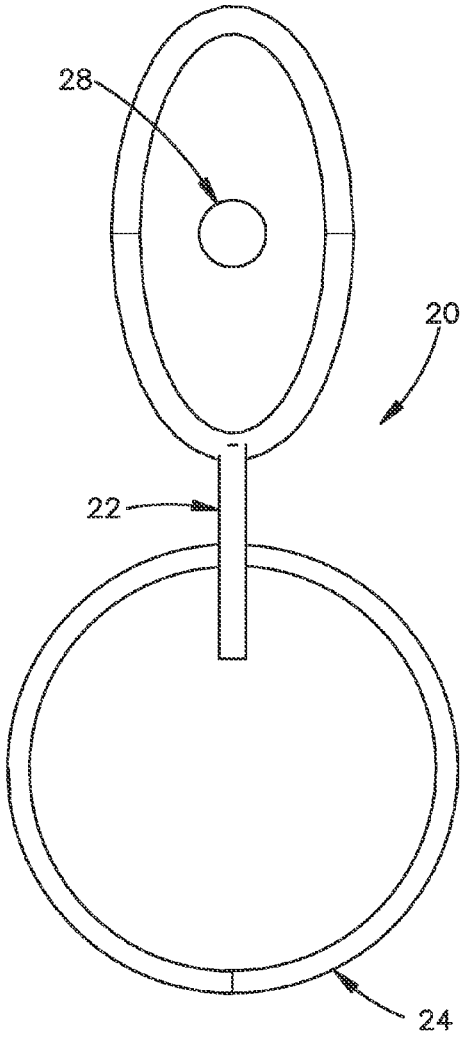
FIG. 2 shows a top view of a safety lifting apparatus according to an embodiment of the present invention, including a compression tube, guide cord, ladder material, and connection ring.

FIG. 2 is a top view of an embodiment of the safety lifting apparatus of the present invention. As shown in FIG. 2, lifting cord 28 passes freely through compression tube 20, unencumbered by ladder 22 or connection ring 24, as these connecting structures do not impinge upon the interior of compression tube 20, but rather are attached to an exterior portion of compression tube 20.

Figure 3:
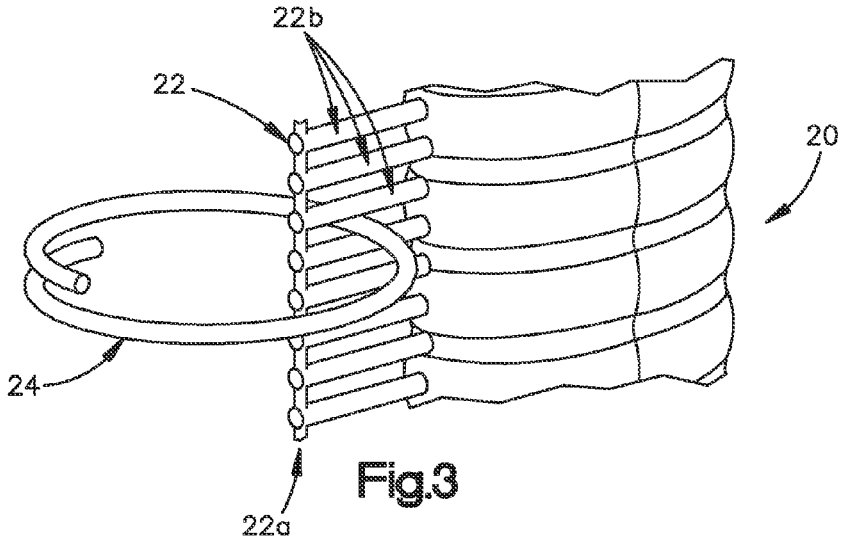
FIG. 3 shows details of the interconnection of a compression tube, ladder, and connection ring according to an embodiment of the present invention.

As shown in detail in FIG. 3, ladder 22 preferably includes a vertical leg 22*a* that attaches to one side of each rung 22*b*, the other side of each rung being attached to (or formed integrally with) compression tube 20. In a preferred embodiment, the rungs are formed and attached to the compression tube by a weaving process. Preferably, the compression tube and ladder material (including the rungs) are formed together in a continuous weaving process. In a preferred embodiment, each rung is of preferably cylindrical shape. As shown in FIG. 3, compression tube 20 in a preferred embodiment has a bellows or accordion-like structure that includes a plurality of concatenated, generally cylindrical pleats. This structure allows compression tube 20 to compress as the shade is raised, and to extend as the shade is lowered. As shown in FIG. 3, connection ring 24 passes between "rungs" of ladder material 22. To permit connection ring 24 to pass between rungs, the spacing between rungs is preferably about 0.125 inches but can vary as understood by a person of ordinary skill in the art. In general, a particular connection ring 24 is not limited to passing between particular rungs of ladder material 22, but rather may be attached at any point along the ladder including being attached to the ladder's vertical leg 22*a* or rung 22*b*. As will be seen, this permits attachment of the assembled compression tube, ladder, and rings at any point along the shade, and provides a way to control the maximum extension of the lifting cord and compression tube away from the back of the shade, so as to remain within industry standard safety limits. FIG. 3 shows a preferred embodiment of the compression tube 20 having the ladder structure 22 as shown and connection ring 24 connected as shown, where the system is disposed vertically on a shade. However, a person of ordinary skill in the art will understand that other embodiments of the invention are included within the scope of this invention. For example, FIG. 3 shows the rungs 22*b* having a preferred cylindrical design but the rungs 22*b* could include other designs such as rectangular or other designs known in the art. In addition, FIG. 3 shows the rungs 22*b* horizontally disposed and having a generally perpendicular relationship with both the vertical leg 22*a* and compression tube 20. Although not shown in the figures, a person of ordinary skill in the art will readily understand that the rungs 22*b* may have different angular or acute relationships with the vertical ladder 22*a* and compression tube 20. Moreover, the preferred embodiment as shown in FIG. 3 includes equidistant spacing between each of the plurality of rungs 22*b*. However, alternative embodiments within the scope of the present invention include a ladder structure 22 having rungs 22*b* with both uniform spacing of about 0.125 inches between each rung 22*b* and varied spacing between one or more rungs. Furthermore, the rungs may take on other shapes such as "X" shapes starting at the top of the ladder and proceeding downward. Moreover, in a preferred embodiment as shown in FIG. 3, the vertical leg 22*a* is generally disposed parallel with the compression tube 20 but alternative embodiments within the scope of the present invention include a vertical leg having acute or obtuse angles with respect to the compression tube 20, starting at the top of the ladder structure 22 in relation to the compression tube 20. Like the rungs 22*b*, the vertical leg 22*a* preferably includes a cylindrical design but it includes other designs such as a rectangular design.

Figure 5:
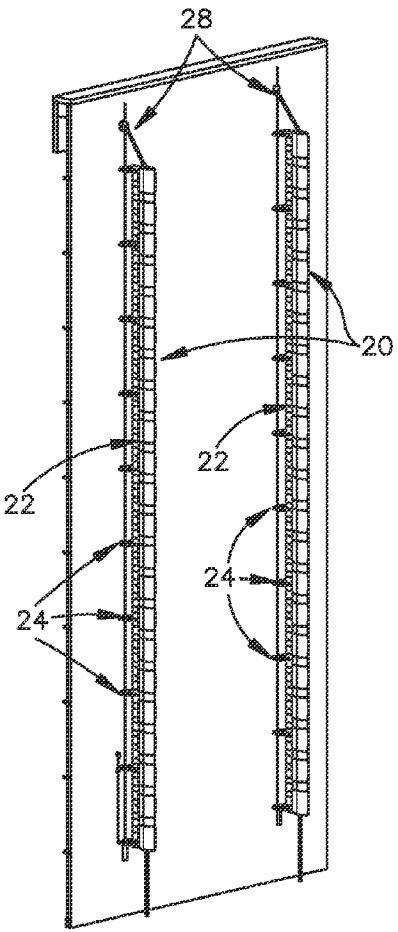
FIG. 5 shows two compression tube assemblies mounted to a shade, and a lifting cord entering the top of each compression tube.

FIG. 5 shows 2 fully assembled compression tubes 20 and lifting cords 28 according to an embodiment of the present invention mounted to the back of a roman shade. While typically two compression tubes 20 and two lifting cords are used, in some embodiments there may be a single compression tube 20 and lifting cord, or in other embodiments there may be more than two. In FIG. 5, the lifting cords may be seen passing through holes near the top of the shade for attachment to a headrail. When the apparatus is fully assembled, the connection rings 24 connect the apparatus to the shade at various points.

Figure 10:
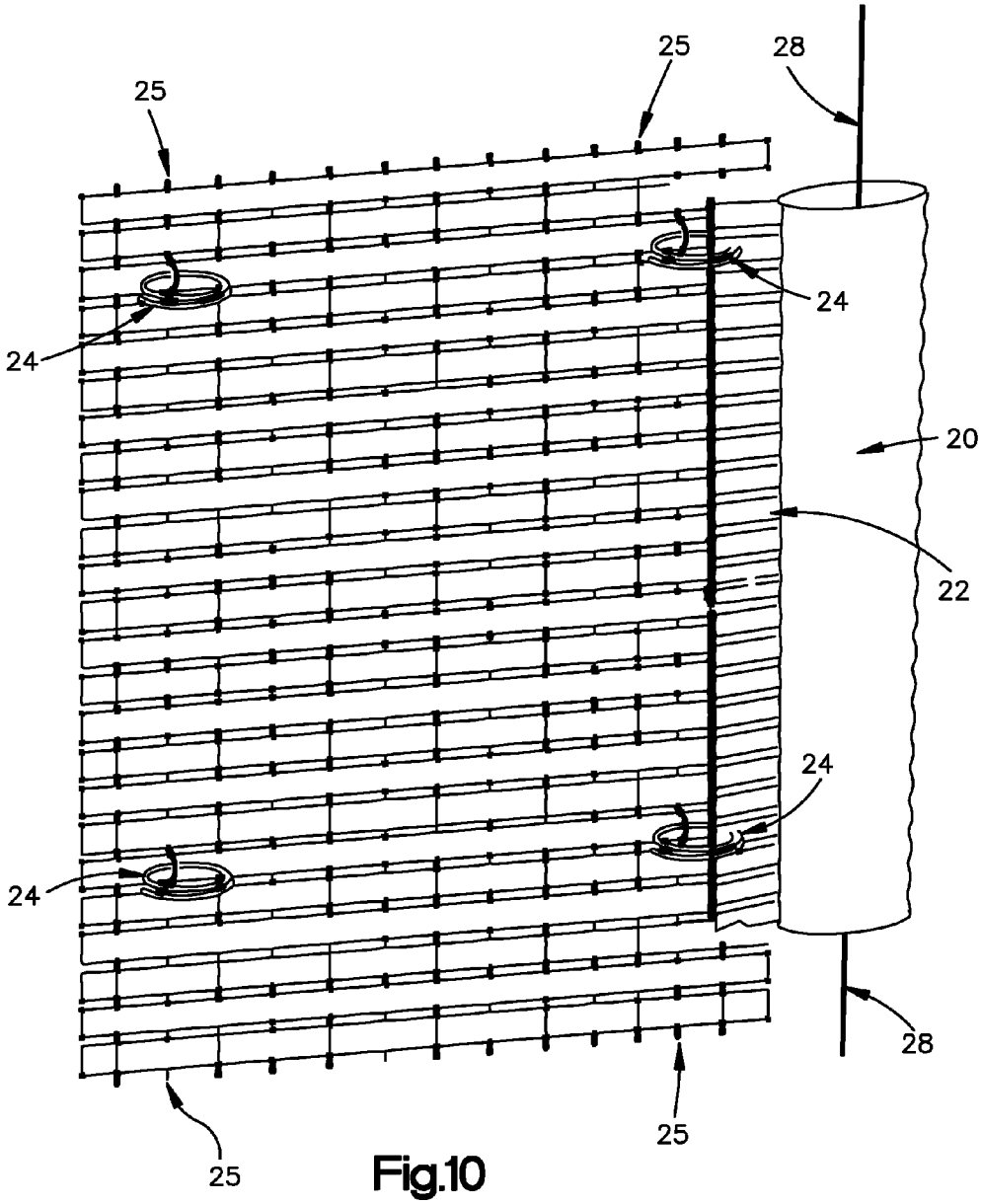
FIG. 10 depicts an exemplary method of attaching a compression tube assembly to a shade.

An example arrangement for connecting the compression tube assembly (tube 20 and ladder material 22) to the back of a shade is shown in detail in FIG. 10. Here, the connection rings 24 are each wrapped around a weaving thread 25 which is woven into the back of the shade, thus securing the compression tube assembly to the shade.

Figure 4A:
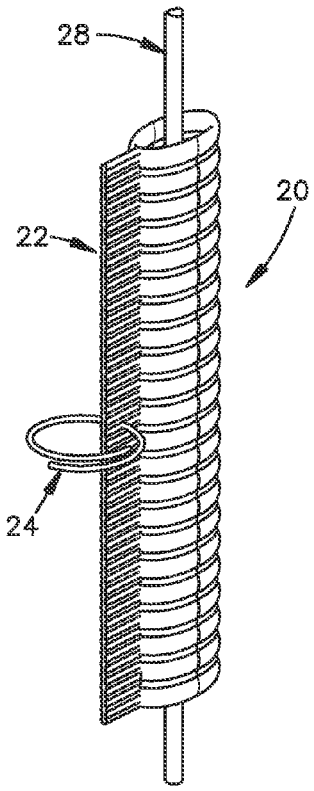
FIG. 4A shows an embodiment of the connection ring having the general shape of a self-overlapping circle.
Figure 4B:
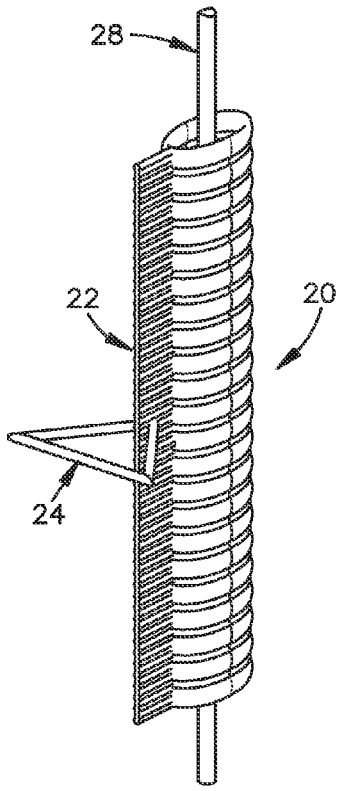
FIG. 4B shows an embodiment of the connection ring having a generally triangular shape.
Figure 4C:
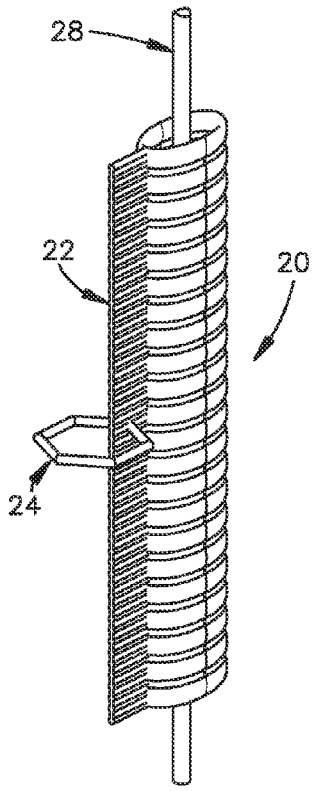
FIG. 4C shows an embodiment of the connection ring having a generally hexagonal shape.
Figure 6B:
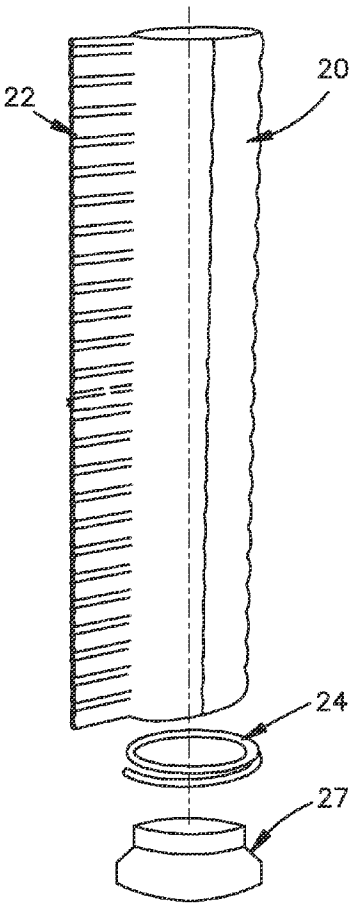
FIG. 6B shows a compression tube with associated ladder, connection ring, and a friction cap for the compression tube.
Figure 6A:
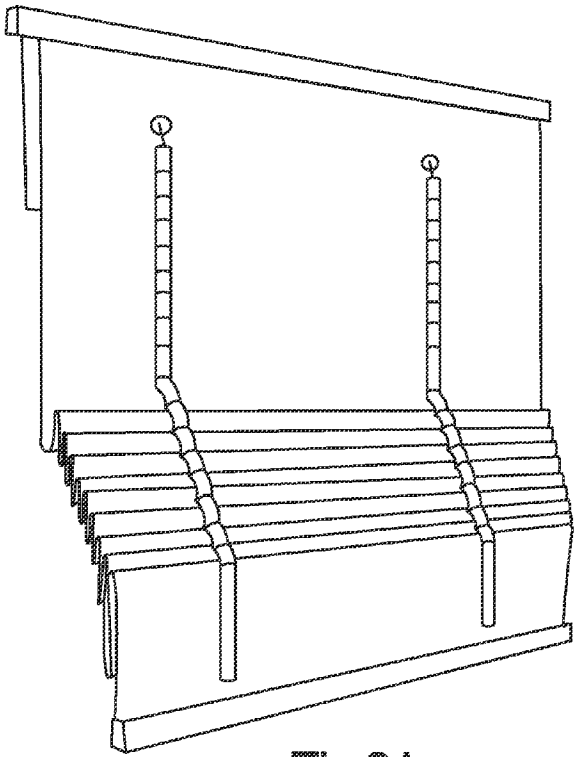
FIG. 6A is another view of two compression tube assemblies mounted on the back of a shade.

FIGS. 4A-4C show a variety of configurations for connection ring 24. Depicted are connection rings 24 with a generally circular configuration (FIG. 4A), a triangular configuration (FIG. 4B), or a hexagonal configuration (FIG. 4C). It will be understood that connection ring 24 can assume any one of these, or some other, configuration or shape FIG. 6B shows a friction cap 27 that can be connected to the bottom of the tube to seal the tube so that the cord is not exposed. FIGS. 11A-C show an exemplary method for securing a friction cap to the compression tube 20. In a first step, a lifting cord 28 is tied to friction cap 27 to support and secure friction cap 27. Next, the bottommost connection ring 24 is secured to the compression tube 20. Finally, friction cap 27 is secured inside bottom ring 24 by placing friction cap 27 into bottom ring 24 at the bottom of compression tube 20.

Figure 7A:
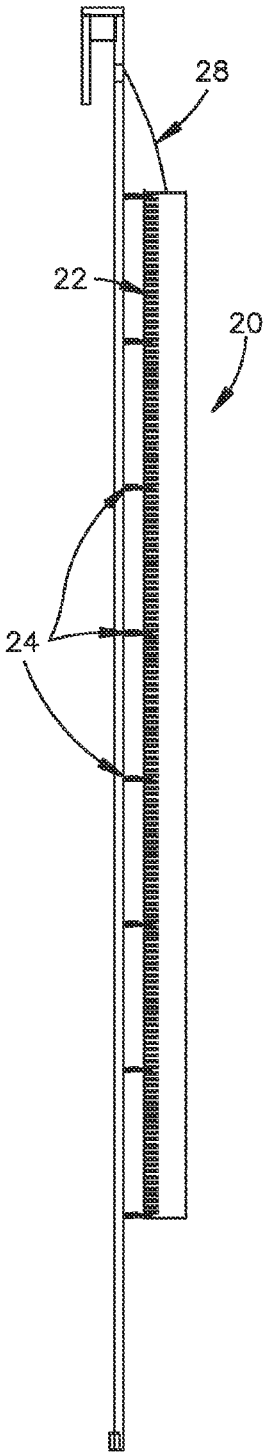
FIG. 7A is a side view of a window shade in a fully "down" position, showing the compression tube and ladder.
Figure 7B:
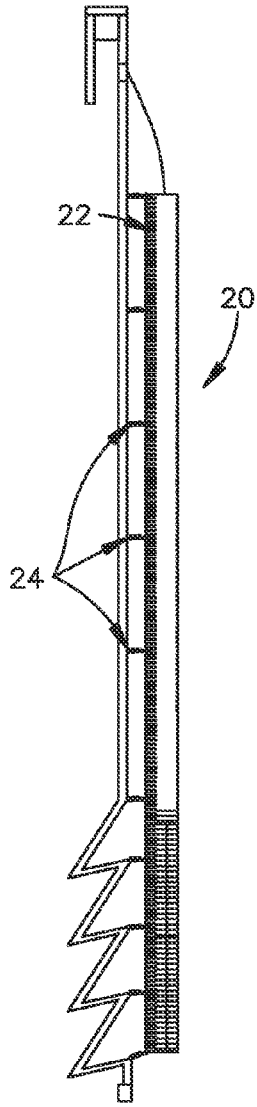
FIG. 7B is a side view of a window shade in an intermediate position, showing the compression tube and ladder.
Figure 8A:
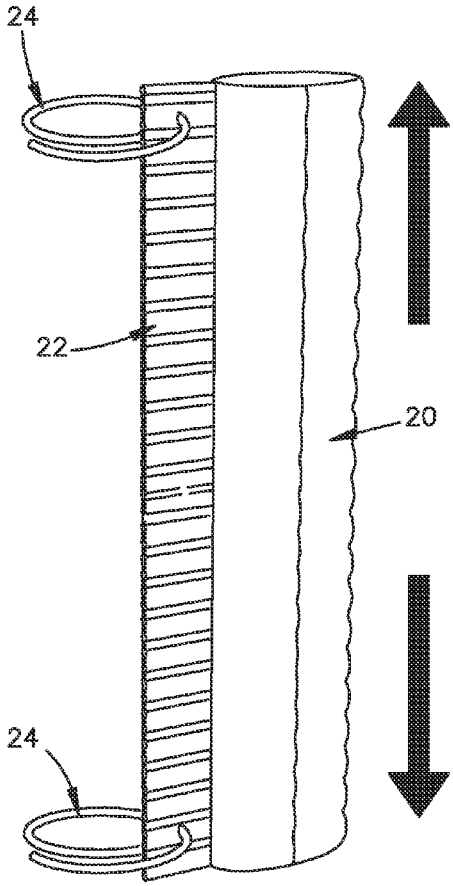
FIG. 8A shows a portion of a compression tube in extension.
Figure 8B:
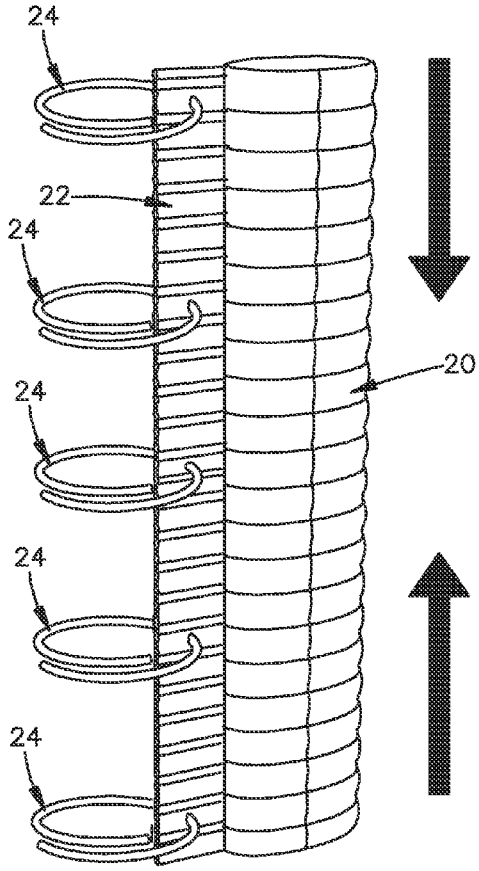
FIG. 8B shows a portion of a compression tube in compression.
Figures 9A, 9B, 9C, 9D:
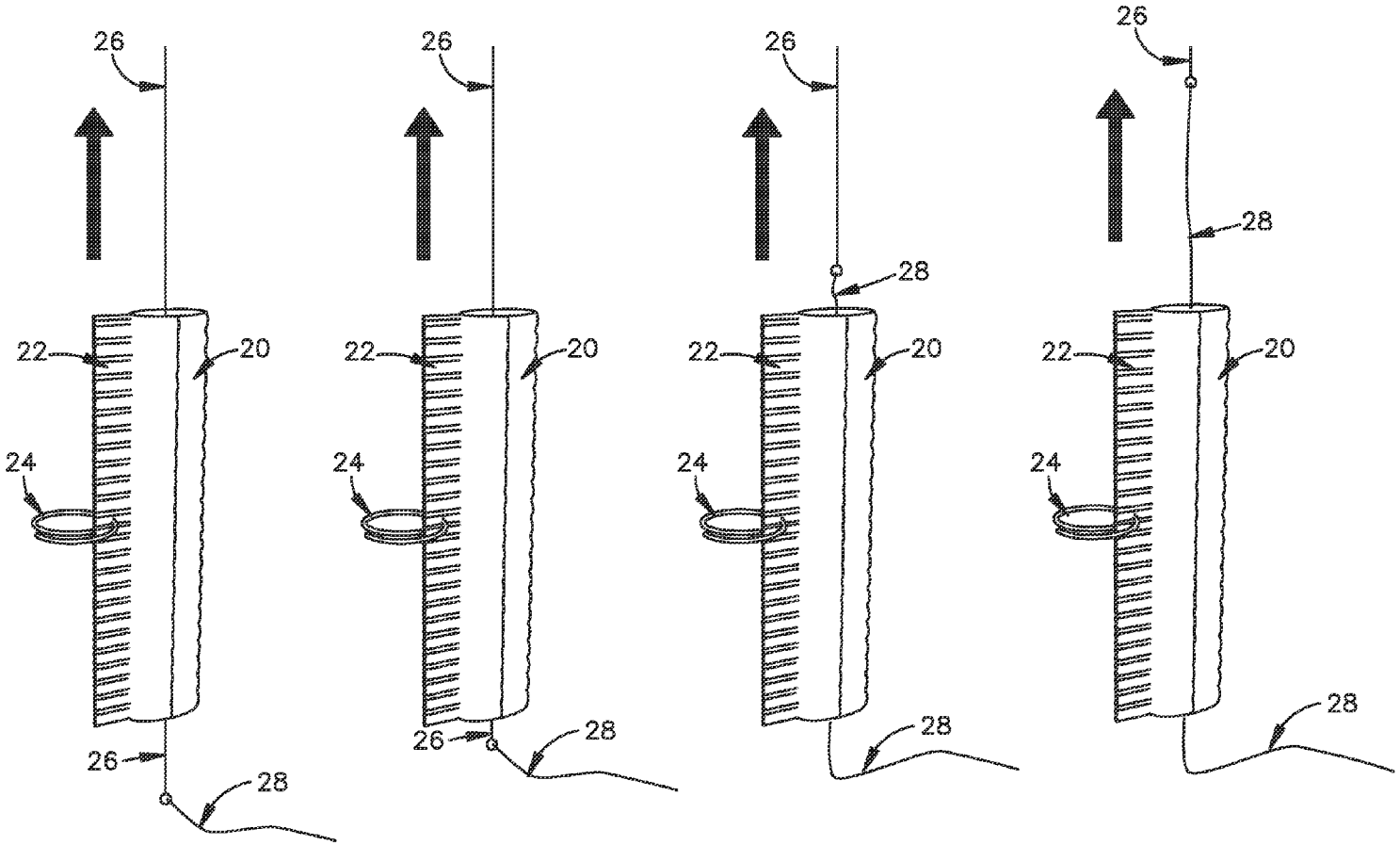
FIG. 9A shows a first step in a process of threading a lifting cord through a compression tube using a guide cord.
FIG. 9B shows a next step in a process of threading a lifting cord through a compression tube using a guide cord.
FIG. 9C shows a further step in a process of threading a lifting cord through a compression tube using a guide cord.
FIG. 9D shows another step in a process of threading a lifting cord through a compression tube using a guide cord.

As shown in FIG. 7A, when the shade is fully extended in the "down" position, compression tube 20 is in a fully extended (uncompressed) configuration. See also FIG. 8A, showing a portion of a compression tube and ladder, with rings, in an uncompressed configuration, corresponding to the shade being in a "down" position. As the shade is raised, for example by pulling on a cord on the front side of the shade (not shown), compression tube 20 compresses and the corresponding rings 24 in the raised portion of the shade move closer together. See FIG. 7B. See also FIG. 8B, showing a portion of a compression tube and ladder, with rings, in a compressed configuration, corresponding to the shade being in an "up" position.

Figure 7C:
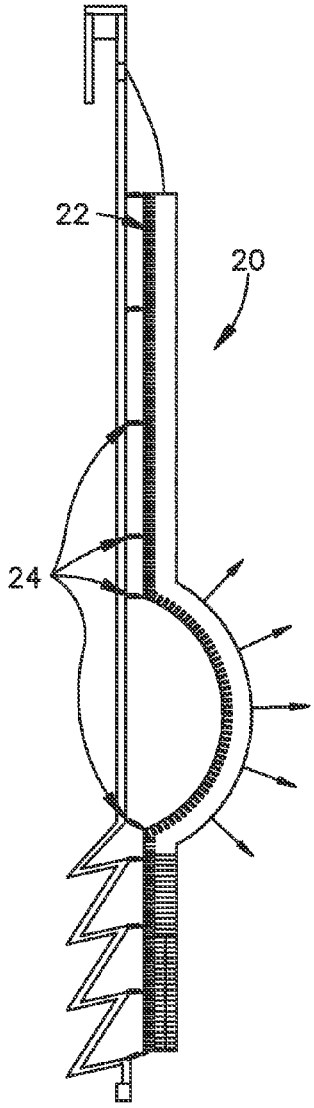
FIG. 7C is a side view of a window shade with compression tube and ladder, showing the limited response of the tube to forces tending to pull it away from the shade.

FIG. 7C shows the effect of a horizontal, vertical, or partly horizontal and partly vertical force applied to the compression tube and lifting cord, for example a force applied by a person such as a child playing with or otherwise manipulating compression tube 20. As shown, any extension of the compression tube in response to such a force is limited by the placement of the connection rings on the back of the shade. In particular, note that in the embodiment shown in FIG. 7C, the portion of the compression tube and attached ladder material that is slightly extended away from the back of the shade in response to the applied force is limited to a portion that extends between two attachment rings. With a suitable choice of inter-ring distances, any extension can be kept to safe limits so that even small children can be prevented from any entanglement, and so that the apparatus meets corresponding industry safety standards, and in particular the ANSI Hazardous Head Probe Test (Fig. D1 of ANSI Standard WCMA 100.1-2012). Preferably, the distance between adjacent rings is about 6 to 7 inches.

A particular advantage of the compression tube of the present invention is that, in some embodiments, manufacturing efficiency is improved. For example, FIGS. 9A-D show that, in the manufacturing process, a guide cord 26 which is, for example, put in place during manufacture of the tube can be used to thread the shade lifting cord 28 through the compression tube. This relies in part on the fact that, in embodiments of the present invention, the attachment rings are threaded through the ladder material, allowing the guide cord and lifting cord to pass freely through the compression tube. Use of the guide cord to thread the lifting cord results in reduced labor costs and faster assembly.

As used in the claims, the recitation "substantially" generally means that the angular relationship may vary by 30 degrees or so, as understood by a person of ordinary skill in the art to allow the window shade lifting apparatus to function effectively.

The description contained herein is for purposes of illustration and not for purposes of limitation. Changes and modifications may be made to the embodiments of the description and still be within the scope of the invention. Furthermore, obvious changes, modifications or variations will occur to those skilled in the art. Also, all references cited above are incorporated herein by reference, in their entirety, for background and to assist the reader of this disclosure.

While the invention has been shown and described herein with reference to particular embodiments, it is to be understood that the various additions, substitutions, or modifications of form, structure, arrangement, proportions, materials, and components and otherwise, used in the practice and which are particularly adapted to specific environments and operative requirements, may be made to the described embodiments without departing from the spirit and scope of the present invention. Accordingly, it should be understood that the embodiments disclosed herein are merely illustrative of the principles of the invention. Various other modifications may be made by those skilled in the art which will embody the principles of the invention and fall within the spirit and the scope thereof.

What is claimed is:

1. A window shade lifting apparatus comprising:

at least one tube disposed substantially vertically on a window shade;

a lifting cord disposed in the tube;

a ladder structure including a vertical leg and a plurality of rungs, the plurality of rungs being connected at a first end to the tube; and at least two connection rings, each connection ring connecting the ladder structure to the window shade.

2. The apparatus of claim 1, wherein the tube includes a bellows or accordion-like structure that includes a plurality of concatenated, generally cylindrical pleats.

3. The apparatus of claim 1, wherein the tube is substantially parallel with the vertical leg, and wherein each of the plurality of rungs is substantially perpendicular to the compression tube and to the vertical leg.

4. The apparatus of claim 1, wherein the tube is a compression tube made of a woven material.

5. The apparatus of claim 4, wherein the tube is capable of collapsing as the shade is lifted to a top position, while the lifting cord freely flows through a center of the compression tube.

6. The apparatus of claim 1, wherein each of the plurality of rungs are equidistant to an adjacent rung, and wherein a second end of the plurality of rungs is connected to the vertical leg.

7. The apparatus of claim 1, wherein a distance between each of the plurality of rungs varies.

8. The apparatus of claim 6, wherein the distance between the adjacent rungs is about 0.125 inches.

9. A window shade lifting apparatus comprising:

at least one compression tube formed of a woven material;

a lifting cord disposed in the compression tube, a ladder structure comprising a vertical leg and a plurality of rungs having a certain distance between each rung and connected at one end to the compression tube; and a plurality of connection rings, each such connection ring passing through a space between adjacent rungs and attached to a window shade.

10. The apparatus of claim 9, further comprising a friction cap fitted to an end of the tube.

11. The apparatus of claim 10, wherein the lifting cord is tied to the friction cap and the friction cap is secured into the bottommost connection ring.

12. The apparatus of claim 9, comprising at least two compression tubes.

13. The apparatus of claim 9, wherein the vertical leg is substantially parallel to the compression tube.

14. The apparatus of claim 9, wherein the vertical leg is substantially perpendicular to the plurality of rungs.

15. The apparatus of claim 9, wherein the ladder is made of a woven material.

16. The apparatus of claim 9, wherein the shade comprises slats, and the connection rings attach to a thread that is woven through the slats.

17. The apparatus of claim 9, wherein the connection ring is substantially circular.

18. The apparatus of claim 17, wherein the connection ring comprises an overlap.

19. The apparatus of claim 9, wherein the connection ring is polygonal.

20. A window shade lifting apparatus comprising:

at least two compression tubes formed of woven material;

a lifting cord disposed in the compression tube;

a ladder structure comprising a vertical leg and plurality of rungs, a first end of each rung being connected to the compression tube, a second end of each rung being attached to the vertical leg; and a plurality of connection rings, each ring being substantially circular, the plurality of rings connecting the ladder structure to a window shade by passing around the vertical leg, passing through a space between adjacent rungs, and passing around a thread woven between slats of the window shade.

* * * * *